US006182921B1

(12) United States Patent
Muylle et al.

(10) Patent No.: US 6,182,921 B1
(45) Date of Patent: Feb. 6, 2001

(54) FLANGE FOR A ROLL

(75) Inventors: Wilfried Muylle, Schoten; Dirk Peeters, Kontich, both of (BE)

(73) Assignee: Agfa-Gevaert, Mortsel (BE)

( * ) Notice: Under 35 U.S.C. 154(b), the term of this patent shall be extended for 0 days.

(21) Appl. No.: 09/218,225

(22) Filed: Dec. 22, 1998

Related U.S. Application Data

(60) Provisional application No. 60/072,703, filed on Jan. 27, 1998, now abandoned.

(30) Foreign Application Priority Data

Dec. 22, 1997 (EP) ..... 97204077

(51) Int. Cl.[7] ..... B65H 75/14
(52) U.S. Cl. ..... 242/608.5; 242/118.61
(58) Field of Search ..... 242/608.5, 609, 242/609.3, 613, 118.61, 118.62

(56) References Cited

U.S. PATENT DOCUMENTS 1,901,737 * 3/1933 Dunlap ..... 242/118.61
1,994,118 * 3/1935 Swanson ..... 242/609.3 X
1,999,765 * 4/1935 Laveau ..... 242/118.61
2,314,749 * 3/1943 Willner ..... 242/188.61
2,988,283 * 6/1961 Garfield ..... 242/613 X

FOREIGN PATENT DOCUMENTS

464623 * 12/1968 (CH) ..... 242/188.61
1837013 8/1961 (DE) .
7326402 2/1974 (DE) .
0594928 5/1994 (EP) .
9500418 1/1995 (WO) .

* cited by examiner

*Primary Examiner*—Donald P. Walsh
*Assistant Examiner*—William A. Rivera
(74) *Attorney, Agent, or Firm*—Baker Botts L.L.P.

(57) ABSTRACT

Flange (20) that is inserted by pressing or screwing into a core (10), such that the flange (20) can be removed manually from the core (10), by exerting a pure torque upon the flange (20).

10 Claims, 4 Drawing Sheets

--Prior Art--

--Prior Art--

-- Prior Art --

FLANGE FOR A ROLL

The application claims the benefit of the U.S. Provisional Application No. 60/072,703 filed Jan. 27, 1998, now expired.

FIELD OF THE INVENTION

The present invention relates to the attachment of a flange to a core.

More specifically the invention is related to the attachment of a flange to a core on which a roll of material is wound.

BACKGROUND OF THE INVENTION

Light-sensitive strip material, e.g. photographic film or paper, a polyester printing plate, or another light-sensitive strip material, can be packaged light-tightly by winding it as a coil on a hollow supporting core, and by attaching a rigid, opaque flange to each end of the core, thus forming a light-tightly packaged roll. The diameter of the flanges is preferably larger than the diameter of the coiled material. A flexible circumferential cover may be secured to the coiled strip material and may cover the coiled strip material by a few complete coils. Preferably, the circumferential cover has a width in excess of the coiled strip material. The side ends of the circumferential cover may slope slightly upwards where they touch the flanges. In this way, a few coils of the circumferential cover shield the light-sensitive strip material from light. It is not required to secure the circumferential cover to the flanges: the package as described above is reliably light-tight. Such a package is used e.g. for recording film marketed by Agfa-Gevaert N.V.

As shown in FIG. 1, the flanges 20 in such a package have a slightly conical hub 23 having outside ribs 24 approximately parallel to the axis 26 of the flange 20. The flanges 20 are pressed into the hollow core 10 and remain attached to the core 10 because of a press fit, i.e. the outside diameter of the hub 23 including the ribs 24 is larger than the inside diameter of the core 10. The ribs 24 serve two purposes: keeping the flanges 20 attached to the core 10 on the one hand, and preventing the flanges 20 from rotating with respect to the core 10 on the other hand. The latter is required because the roll is driven via the flanges 20 in some cooperating apparatuses in which the roll is placed. Usually, these cooperating apparatuses dispense light-sensitive strip material from the roll.

The attachment of the flanges to the core described above, however, presents a problem of reliability. The attachment is not reliable because the dimensional tolerances of the flanges and the core are critical. A flange may become detached from the core due to shocks during shipping, or due to relaxation of the core (the core is usually made of cardboard) or by someone lifting the roll by one of its flanges, etc. If a flange becomes detached, the light-sensitive strip material is exposed, whereby the roll is wasted.

Patent FR-A-1 236 361 discloses a coupling part that supports a roll of strip material; the coupling part will be referred to as "flange" below. As shown in FIG. 2, the flange 20 has in the direction of its axis 26 a number of triangular protrusions 25 that are slightly inclined at the side of the centre of the roll and steeply inclined at the side of the end of the roll. In this way, the flange 20 can be inserted into the hollow, cardboard core 10 of the roll, and, once attached, cannot be removed from the core without damaging the core. Because of the protrusions 25, the core 10, and thus also the roll, cannot rotate with respect to the flange 20.

While this attachment may solve the problem concerning reliability, and while it may also allow the roll to be driven via the flanges, it still presents a problem. The flanges cannot easily be removed from the roll; removal damages the core.

Usually, such flanges are made of plastic, e.g. of polystyrene. Because of environmental considerations, it is highly desirable that the flanges can be removed easily from the roll, so that they can be re-used or recycled after the use of the roll.

In document DE-U-73 26 402, flanges are disclosed that are used during shipping of rolls of e.g. textile fabric or material for carpets. First, the fabric is wound onto a core, that is made of cardboard. Then, two identical flanges are inserted, one flange into each end of the core. Subsequently, the roll is shipped; when the roll is handled, e.g. by a forklift truck or another machine, it can now be handled by means of the flanges, so that damage to the roll is avoided; this is the purpose of the flanges. Subsequently, before the roll is put onto the equipment on which it is to be used, the flanges must be removed from the core, since the core is put directly onto the equipment.

FIGS. 3*a* and 3*b* show a flange 20 as disclosed in this document; FIG. 3*a* is a side view, partially showing a section, and FIG. 3*b* is a top view. The flange 20 has a disc portion 21 and a hub portion 23. The hub portion 23 contains screw thread 30 in the hub area near the disc portion 21; the screw thread has a steep slope (which corresponds to a small angle $\lambda$ in FIG. 4) so that a very large force is required to pull a flange out of the core in which it is inserted. The end 27 of the hub portion 23 that is away from the disc portion 21 has a sharp chamfer. The disc portion has either protruding elements 28 or holes 29.

A flange 20 is inserted into a core 10 (not shown in FIGS. 3*a* and 3*b*) as follows. First, the chamfered end 27 of the hub portion 23 of the flange is pressed into the core and then the rest of the hub portion 23, as far as the start of the screw thread 30. Then, the remaining portion of the hub portion 23, i.e. the portion containing the screw thread 30, is screwed into the core by means of a tool. The tool includes a lever, so that a high torque can be applied; the tool either has holes that fit into the protruding elements 28 of the disc portion 21 or has protruding elements that fit into the holes 29 of the disc portion 21. The core does not contain screw thread; when screwing the flange 20 into the core, a screw thread is cut or pressed into the core that corresponds to the screw thread 30 of the flange 20.

To remove the flange 20 from the core, the same tool is used to screw the flange out of the core.

This system presents the disadvantages that large forces have to be applied and that a special tool is required to insert a flange into the core and to remove it from the core.

OBJECTS OF THE INVENTION

It is an object of the present invention to provide flanges for a roll, that reliably remain attached to the core during shipping, handling and use of the roll.

It is a further object of the invention to provide flanges that can easily be removed from the core—preferably without damaging the core—after use of the roll.

It is another object of the invention to provide flanges that can be used to drive the roll in a cooperating apparatus.

SUMMARY OF THE INVENTION

The above mentioned objects are realised by a method for attaching a flange having a helical protrusion to a core having a smooth inner surface. The method includes inserting the flange into the core so that the inserted flange is manually removable from the core by exerting a pure torque upon the flange.

The above mentioned objects are realised by a composition having a core and a flange. The core has an inner diameter d, a smooth inner surface, a centre, and an end. The flange has a disc portion having a first outer diameter and a hub portion for fitting in the core. The hub portion has a second outer diameter D and a helical protrusion, which has a height h. The first outer diameter of the disc portion is larger than 40 mm and smaller than 200 mm. The inner diameter d of the core, the second outer diameter D of the hub portion, and the height h of the helical protrusion are such that the flange is manually removable from the core by exerting a pure torque upon the flange A specific feature of the method is that the flange is manually removable from the core by turning the flange by at most two complete revolutions.

Another method includes inserting first and second flanges into opposite ends of the core, each flange having a helical protrusion. The first flange can be removed manually from the core in a first removal direction, by exerting a pure torque upon the first flange in a first rotation sense. The combination of the first rotation sense and the first removal direction has a first sign according to the right-handed screw convention. The second flange can be removed manually from the core in a second removal direction, by exerting a pure torque upon the second flange in a second rotation sense. The combination of the second rotation sense and the second removal direction has a second sign according to the right-handed screw convention, this second sign being opposite to the first sign.

A feature of this method is that a roll of strip material can be coiled onto the core, the strip material preferably being radiation-sensitive. Preferably, a flexible circumferential cover can be secured to the strip material which covers the strip material by a few complete coils, so that the strip material is light-tightly packaged.

A feature of the composition is that it has a force efficiency $\eta>1$, where $\eta$ is the ratio of the force required to pull the flange axially out of the core, divided by the force required to press the flange axially into the core. Another feature of the composition is that the helical protrusion can be characterised by angles $\alpha$ and $\beta$, with angle $\alpha$ being smaller than angle $\beta$. Angle $\alpha$ is the angle between the helical protrusion and the inner surface of core at the side of the centre of the core. Angle $\beta$ is the angle between the helical protrusion and the inner surface of the core at the side of the end of the core.

Further advantages and embodiments of the present invention will become apparent from the detailed description and drawings hereinafter.

DEFINITIONS

FIG. 4 shows a "helix" 32. A helix is also known as a screw line; a corkscrew has a helical shape. Defined mathematically, a helix is a curve on a cylindrical surface or on a conical surface; on a cylindrical surface, a helix satisfies the mathematical relation:

$$x=r^*\cos(\omega t);\ y=r^*\sin(\omega t);\ z=r^*\ \omega t^*\tan(\lambda),$$

wherein r is the radius of the cylinder, $\omega$ is a constant, t is a parameter $\geqq 0$, and $\lambda$ is the helix angle. The helix angle $\lambda$ as shown in FIG. 4, is the angle between the helix 32 and a plane perpendicular to the axis 26 of the cylinder; for a helix, this angle 80 is constant. Special cases—not real helices—occur for $\lambda=0°$, where the helix becomes a circle, and for $\lambda=90°$, where the helix becomes a straight line parallel to the axis of the cylinder. For a helix on a conical surface, the only difference from a helix on a cylindrical surface is that the radius r is no longer constant.

Instead, $$r=c+d^*z,$$

wherein c is a positive constant and d is a constant that may be positive or negative.

A "helical protrusion" is a protrusion or a plurality of protrusions substantially arranged on a helix; to exclude the special cases mentioned above, the helix angle $\lambda$ is limited to $0.1°<\lambda<89.9°$ or $-89.9°<\lambda<-0.1°$. The protrusion may be long, spanning e.g. a complete revolution of the helix around the cylinder or cone (with $\omega t$ varying from 0° to 360°). Such a helical protrusion is in fact a screw thread or a portion of screw thread (see also FIG. 4). The protrusion may also be short, having a length of e.g. a few mm (see also FIG. 5). Each protrusion may have any length, from a few mm or less, to a length corresponding to several revolutions of the helix.

To determine whether a protrusion or a plurality of protrusions are arranged substantially on a helix, first a curve S and an angle $\sigma$ are associated with the protrusion (s) as follows. Curve S, shown in FIG. 5, is the curve on which the protrusion lies; it is defined as the curve on the cylinder or cone lying half-way between the curves S1 and S2 where the protrusion touches the cylinder or cone on which it lies, S1 and S2 being curves in the longitudinal direction of the protrusion. The angle a of curve S is defined in the same way as a helix angle 80 , i.e. $\sigma$ is the angle between S and a plane perpendicular to the axis 26 of the cylinder or cone on which S lies. For a helix, however, $\lambda$ is constant, whereas $\sigma$ may vary.

A protrusion or a plurality of protrusions are arranged substantially on a helix H with helix angle $\lambda$., if the difference between $\sigma$ and $\lambda$ is smaller than 10°; e.g. if $\lambda=25°$, then a may vary between 15° and 35°. Moreover, $\sigma$ should be $0°<\sigma<90°$ or $-90°<\sigma<0°$.

A "pure torque" is a torque without axial pulling or pushing force, i.e. without a force-component parallel to axis 26 in FIGS. 4 and 5. In another embodiment, removing a flange 20 from a core 10 by means of a "pure torque" means that upon the flange 20 first a torque is exerted without axial pulling or pushing force, followed by exerting a small axial pulling or pushing force upon the flange 20; "small" means that the force is smaller than ten times the weight of the flange 20, preferably smaller than five times the flange weight, more preferably smaller than twice the flange weight. The cause of this small axial force may be the following. If a core 10 is oriented vertically (as shown in FIG. 7), after the flange 20 is turned out of the core by applying a torque without an axial force, the flange 20 still has to be lifted out of the core 10, which means that a force at least equal to the flange weight has to be applied. In still another embodiment, an operator may remove a flange 20 from a core 10 by exerting a torque and an axial force at the same time upon the flange 20, although a "pure torque" would be sufficient. As will be explained hereinafter, in an embodiment in accordance with the invention a flange 20 can be removed from a core 10 by exerting a "pure torque" upon the flange 20, but of course the operator who removes the flange 20 may also exert an axial pulling or pushing force, although this axial force is not required. What is important for the invention is that the flange 20 may be removed by means of a pure torque; of course the operator can exert other forces upon the flange at the same time, even although these forces are not required to remove the flange.

By removing "manually" a flange from a core, is meant that the operator can remove the flange by contacting the flange directly with a hand, without using any tools such as e.g. a screwdriver. In another embodiment, removing a flange "manually" from a core means that the torque exerted upon the flange by the operator is not higher than 30 Nm, preferably lower than 20 Nm, more preferably lower than 15 Nm, still more preferably lower than 10 Nm and most preferably lower than 8 Nm.

The "right-handed screw convention" is the following convention in mathematics (see also "Webster's Third New International Dictionary", 1993): if linear motion is produced perpendicular to a plane by a rotation in the plane in a given rotation sense, the direction of the linear motion will be that of the usual motion along its axis of a right-handed screw with axis perpendicular to the plane and with the given rotation sense in a resisting medium. To apply this convention to a composition of a flange inserted in a core, the flange can be replaced by a right-handed screw and the core by a resisting medium in which the screw is inserted. When removing the flange from the core in a given removal direction, by exerting upon the flange a torque having a given rotation sense, the combination of the given removal direction and the given rotation sense has a positive sign according to the right-handed screw convention, if a torque with the given rotation sense, when exerted upon a right-handed screw, removes the screw from the resisting medium in the same given removal direction. If, in order to produce the same removal direction, the flange has to be replaced by a left-handed screw, then the combination of torque rotation sense and removal direction is negative according to the right-handed screw convention.

The "force efficiency $\eta$" of a composition of a core and a flange is $\eta=F_{out}/F_{in}$, wherein $F_{in}$ is the force required to press the flange axially into the core, and $F_{out}$ is the force required to pull the flange axially out of the core. Thus, if $\eta>1$, a larger force is required to pull the flange out of the core than to press it into the core.

BRIEF DESCRIPTION OF THE DRAWINGS

The invention is described hereinafter by way of example with reference to the accompanying figures, wherein.

DETAILED DESCRIPTION OF THE INVENTION

Figure 1:
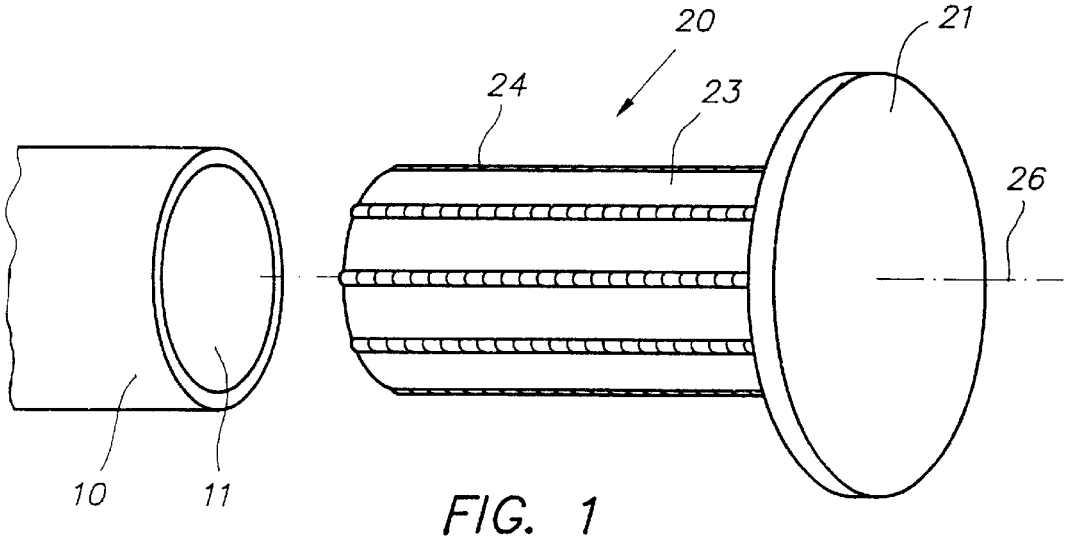
FIG. 1 shows a prior art flange having ribs.
Figure 2:
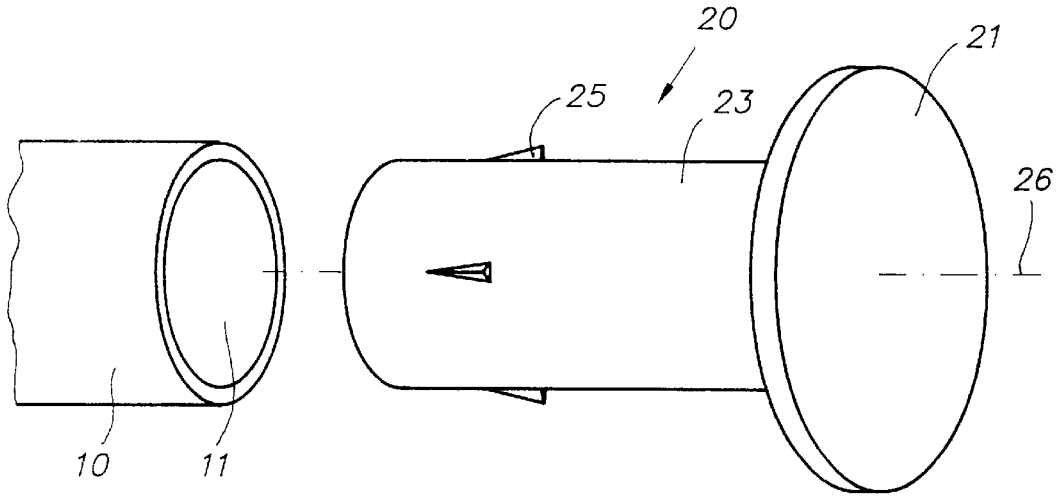
FIG. 2 shows a prior art flange having protrusions.
Figure 3B:
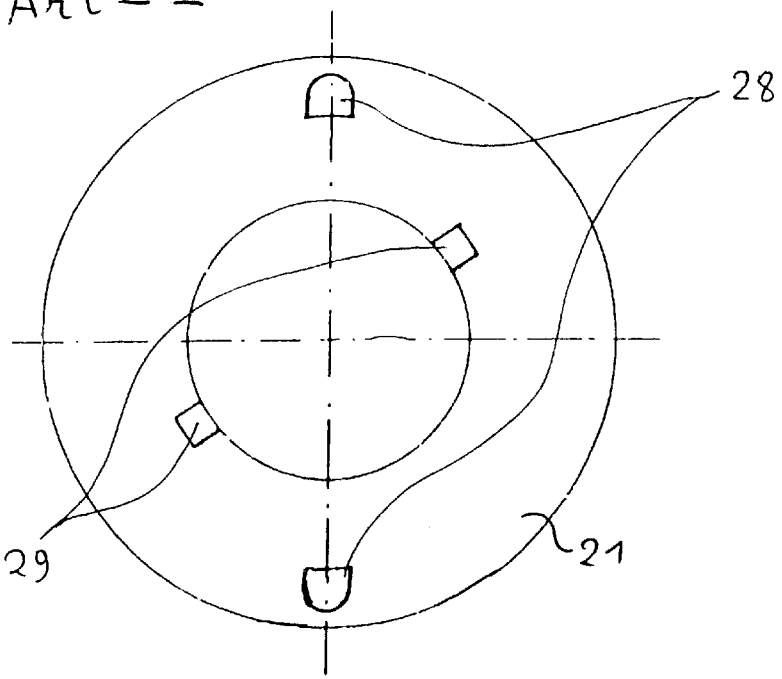
FIG. 3*a* and FIG. 3*b* show different views of a prior art flange having screw thread and a chamfered end.
Figure 3A:
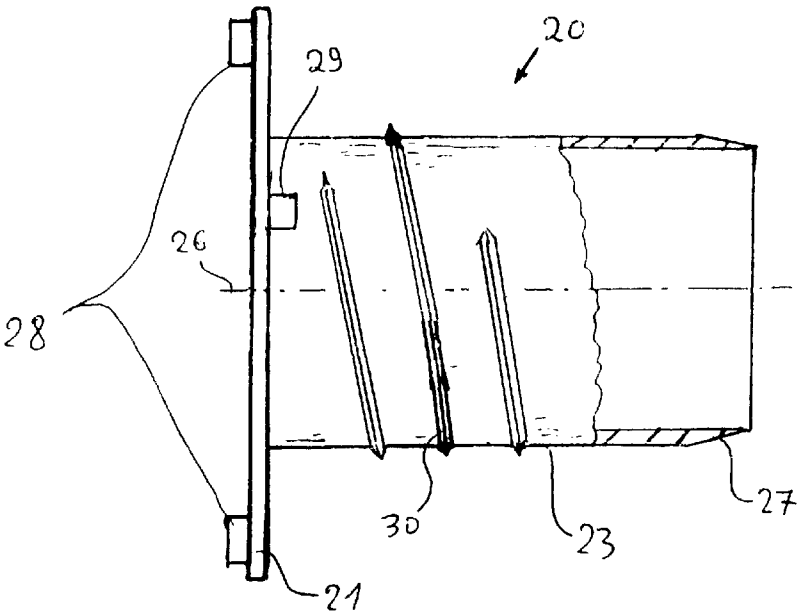

FIGS. 1 to 3 show prior art flanges that were extensively described hereinbefore. Flange 20 in FIG. 1 is pressed into core 10 at a first end 11 of the core. Flange 20 has a disc portion 21 and a slightly conical hub portion 23 comprising outside ribs 24 in the direction of the axis 26 of the flange. Such a flange is used in packaging recording film marketed by Agfa-Gevaert N.V. FIG. 2 shows a flange 20 that has a hub portion 23 comprising triangular protrusions 25 in the direction of the axis of the flange; the protrusions are steeply inclined at the side of the disc portion 21 and slightly inclined at the opposite side. FIGS. 3*a* and 3*b* show a prior art flange, having screw thread 30 and a chamfered end 27, that must be inserted into a core (not shown) by means of a special tool.

Figure 7:
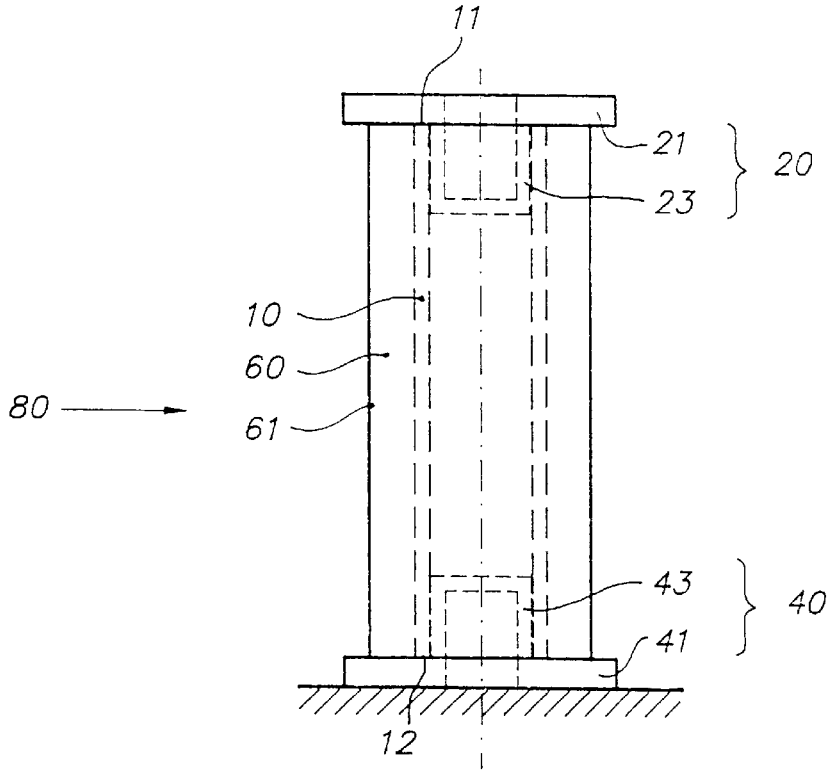
FIG. 7 shows a schematical representation of a roll comprising two flanges.

FIG. 7 shows a schematical representation of a roll 80, standing on the floor. Strip material 60 is coiled on core 10; a circumferential cover 61 is secured to the coiled strip material 60 as explained hereinbefore. A first flange 20, having a disc portion 21 and a hub portion 23, is attached to the core 10 at a first core end 11, and a second flange 40, having a disc portion 41 and a hub portion 43, is attached to the core 10 at the opposite end 12 of the core. The strip material 60 is light-tightly packaged, as explained hereinbefore.

Figure 4:
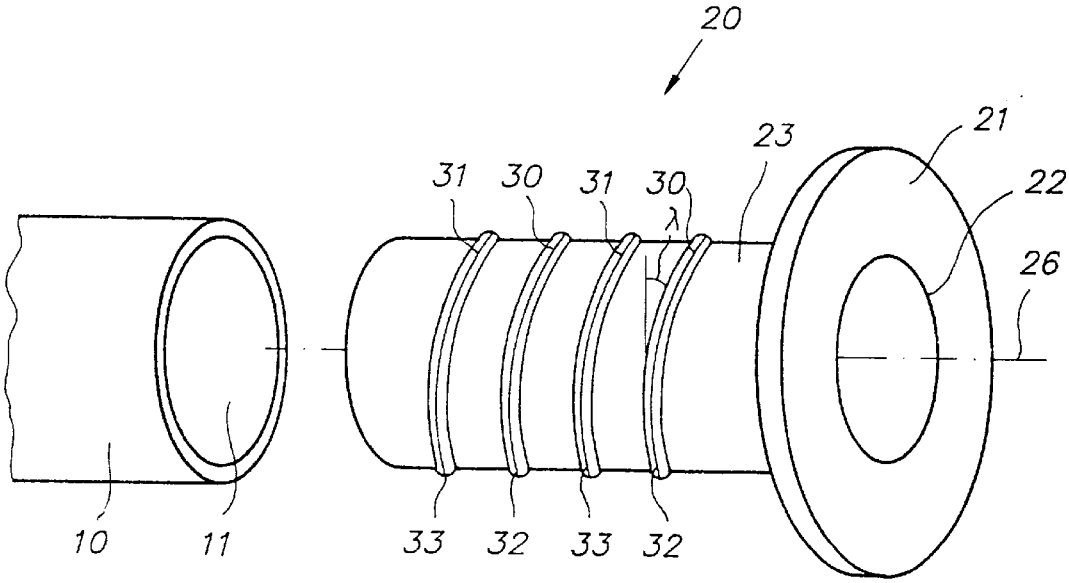
FIG. 4 shows an embodiment of a flange in accordance with the present invention.
Figure 5:
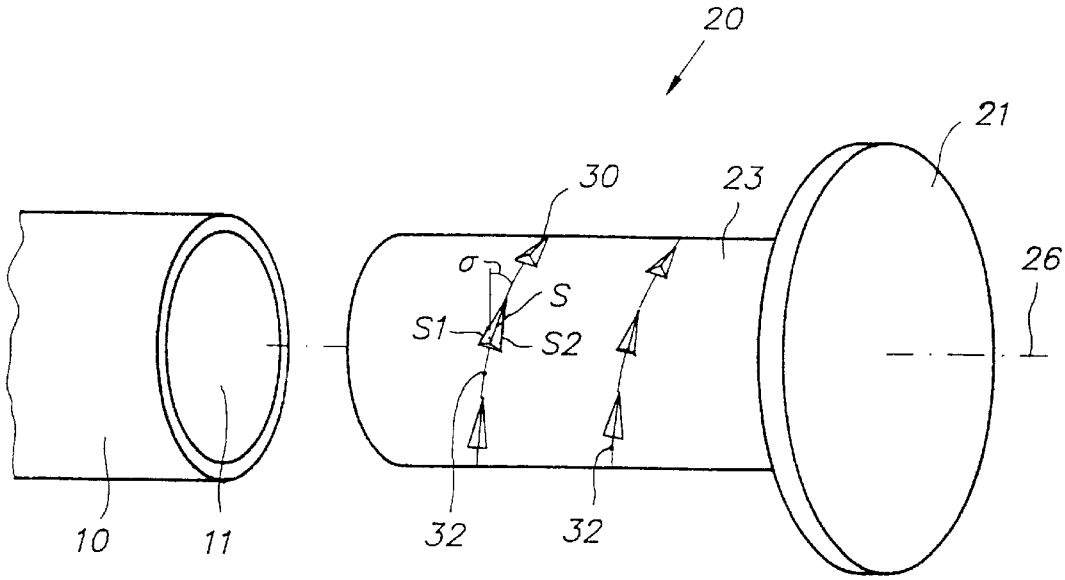
FIG. 5 shows another embodiment of a flange in accordance with the present invention.

FIG. 4 and FIG. 5 show different embodiments of a flange 20 according to the current invention.

FIG. 4 shows a flange having a disc portion 21 and a hub portion 23. According to this embodiment, the flange is hollow: the disc 21 has an inner diameter 22. Two helical protrusions 30 and 31 are formed on hub 23. Each helical protrusion is long and continuous, as opposed to the short, discrete protrusions in FIG. 5. The helical protrusions in FIG. 4 are in fact screw thread. Helical protrusion 30 is arranged on a first helix 32 having a helix angle $\lambda$ and helical protrusion 31 is arranged on a second helix 33. Core 10 preferably has a smooth inner surface, without protrusions or recesses: no internal screw thread in the core is required.

FIG. 5 shows a non-hollow flange 20 having discrete protrusions 30 arranged on a helix 32. In fact, the discrete protrusions may be short portions of screw thread.

Figure 6:
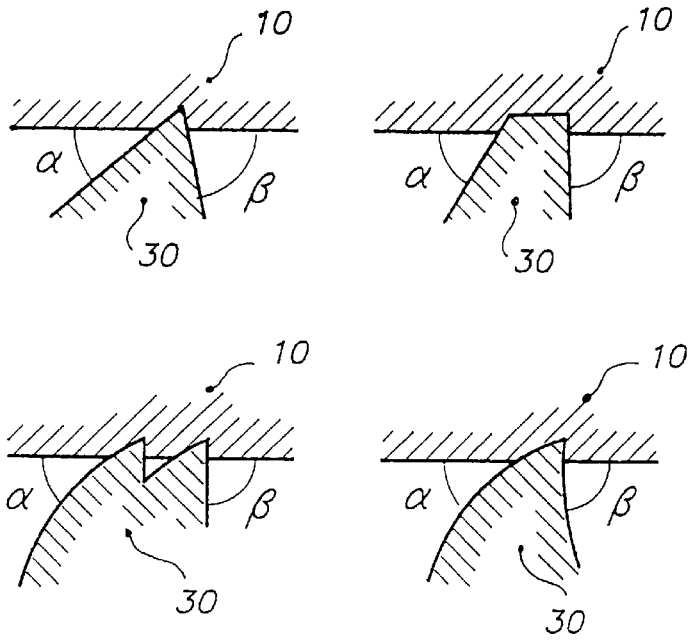
FIG. 6 shows embodiments of cross sections of helical protrusions in accordance with the present invention.

Different embodiments of cross sections of helical protrusions are shown in FIG. 6 and will be discussed hereinafter.

Because of the helical protrusions shown in FIG. 4 and FIG. 5, the flange can be inserted into the core by pressing or screwing and can be removed from the core by exerting a pure torque around the axis 26 upon the flange, i.e. a torque without extra pulling force in the direction of the axis 26. The helical protrusions convert the torque—i.e. the forces applied in a rotational direction—into a translational movement of the flange, in the direction of the axis 26. In case of discrete protrusions, as shown e.g. in FIG. 5, each discrete protrusion is preferably slightly chamfered in the unscrewing direction, to ease rotational removal of the flange.

In this way, the flange can easily be removed without damaging the core.

On the other hand, a large axial force parallel to the axis 26 is required to pull the flange out of the core. Values of the axial removal force can be found in the Examples hereinafter. Because of the high axial removal force, the flanges reliably remain attached to the core during shipping, handling and use of the roll.

FIG. 6 shows different embodiments of a cross section of a core and a flange inserted in the core; only a portion of the helical protrusion 30 and a portion of the core 10 are shown. The cross sections are obtained by cutting the helical protrusion and the core by a meridian plane, i.e. a plane through the axis 26 of the hub 23 of the flange 20. The angle $\alpha$ is the angle between the helical protrusion 30 and the core 10 at the side of the centre of the core; $\beta$ is the angle between the helical protrusion 30 and the core 10 at the side of the end 11 of the core. In a preferred embodiment, angle $\alpha<\beta$, so that the helical protrusion functions as a barb, requiring a large force to pull the flange 20 axially out of the core 10 and only a small force to press the flange into the core. In another embodiment, angle $\alpha>\beta$, and the helix angle $\lambda$ is so small that a large force is required to pull the flange 20 axially out of the core 10. In a preferred embodiment, the force efficiency $\eta>1$, so that a larger force is required to pull the flange out of the core than to press it into the core.

As described hereinbefore and shown in FIG. 7, a strip material 60 may be coiled on the core 10. In a preferred embodiment, the strip material 60 is light-sensitive. In a still more preferred embodiment, a flexible circumferential cover 61 is secured to the strip material 60 and shields the strip material 60 from light, as explained hereinbefore.

A roll 80 as shown in FIG. 7 is manufactured as follows. The flanges 20, 40 are inserted into the core 10 by pressing—according to another method, the flanges are screwed into the core. The strip material is coiled upon the core. The circumferential cover is secured to the strip material and is coiled upon the strip material.

In a preferred embodiment, the core 10 is hollow over its complete length, as shown in FIG. 7. In another embodiment, the core is solid inside and has a hollow portion near its end 11 (see also FIG. 4) so that the hub portion 23 of flange 20 fits into the core 10.

In a preferred embodiment, flange 20 is hollow over its complete length, as shown in FIG. 4. In another embodiment, shown in FIG. 5, flange 20 is solid. In yet another embodiment, the flange is solid but has a hollow portion at the side of its disc portion 21.

A (partly) hollow flange can be driven more easily in a cooperating apparatus, because a driven hub can be inserted into the flange. For a roll having two flanges according to the present invention, if the roll is to be driven via the flanges, it is preferred that the first flange 20 has a helical protrusion on a right-hand turning helix and the second flange 40 has a helical protrusion on a left-hand turning helix, or vice versa; i.e. if the flanges are to be removed from the core by torques exerted upon the flanges, for the first flange 20 the combination of the removal direction of the flange and the rotation sense of the torque has a positive sign according to the right-handed screw convention, while for the second flange 40 the combination has a negative sign according to the right-handed screw convention, or vice versa. Thus, when driven in the apparatus, the flanges are pushed into the core by the torque applied by the driving motor. If both flanges had identically turning helices, one of the flanges could be unscrewed by the motor torque.

In one embodiment of the present invention, hub 23 comprises helical protrusions 30 on two or more helices. FIG. 5 shows discrete, short helical protrusions located on a single helix 32. FIG. 4 shows a first helical protrusion 30 on a first helix 32, and a second helical protrusion 31 on a second helix 33. The helical protrusions may also lie on three or more helices. If a hub contains helical protrusions on two or more helices, preferably these helices have equal or substantially equal helix angles.

In another embodiment, hub 23 comprises a combination of discrete, short helical protrusions as shown e.g. in FIG. 5 and of long helical protrusions as shown e.g. in FIG. 4. Such a combination of helical protrusions may lie on the same helix or it may lie on two or more helices; the latter case includes e.g. a combination of a long, continuous helical protrusion on a first helix and of discrete, short helical protrusions on a second helix.

In a preferred embodiment, hub 23 comprises only long, continuous helical protrusions—in fact screw thread—on one or more helices, and hub 23 does not comprise short, discrete helical protrusions.

Preferably, the pitch of the helical protrusion (s) is large enough so that a few turns are sufficient to remove the flange from the core. The pitch is the distance, measured in a meridian plane through the axis 26 of the flange 20, between two adjoining cross sections of helical protrusion (s); the pitch is also the distance that the flange is turned out of the core, when turning the flange by a complete revolution. If the helical protrusion is a screw thread, the pitch of the helical protrusion is equal to the pitch of the screw thread as known in the art.

In a preferred embodiment, the pitch is so large with respect to the length of the flange, that two complete revolutions or less of the flange suffice to remove it from the core. Preferably, the helix angle $\lambda$ is $2°<\lambda<85°$, more preferably $5°<\lambda<60°$, still more preferably $5°<\lambda<45°$. For negative $\lambda$, preferably $2°<-\lambda<85°$, more preferably $5°<-\lambda<60°$, still more preferably $5°<-\lambda<45°$.

In a preferred embodiment, the flange 20 is made of an opaque polymeric material. In a more preferred embodiment, the flange is made of opaque polystyrene. The flange may also be made of metal. The core 10 may be made of an opaque polymeric material. In a preferred embodiment, the core is made of cardboard. Preferably, the core is made of a material that is more resilient than the material the helical protrusion is made of. Preferably, the helical protrusion is made from the same material as the hub portion of the flange, while the core may be made from another material.

In an embodiment in accordance with the present invention, the characteristics of the composition consisting of the flange 20 and the core 10 are such that the flange 20 can be removed manually from the core 10. The characteristics that are important to allow manual removal are the material properties of both the flange 20 and the core 10, their dimensions and the tolerances on these dimensions. In the Examples below, values are given of the characteristics of a composition of a flange and a core in accordance with the present invention, without the intention to limit the invention thereto; the value of the torque that is required to remove the flange from the core is given as well.

For manual removability, the most important characteristics are the materials that the core 10 and the helical protrusion on the hub portion 23 of the flange 20 are made from, the internal diameter of the core 10, the external diameter of the hub portion 23 of the flange 20, and the geometry and especially the height of the helical protrusion on the hub portion 23. With:

d: the inner diameter of the core;

$D_{max}=D+2*h$: the maximum diameter of the hub portion of a flange including its helical protrusions;

D: the outer diameter of the hub portion of the flange;

h: the height of the helical protrusions (which is measured in a plane perpendicular to axis 26, so that if $D_{max}=d$, a hub portion with helical protrusions exactly fits in the core);

in an embodiment in accordance with the present invention, the maximum diameter $D_{max}$ is larger than the inner core diameter d, so that the difference $D_{max}-d$ is not larger than 2 mm, preferably smaller than 1 mm, more preferably smaller than 0.7 mm and most preferably smaller than 0.5 mm, for a flange made of a polymeric material and for a cardboard core having an inner diameter d=72 mm and a thickness between 2 and 3 mm; if the core diameter d is larger or smaller than 72 mm, the above limiting values for $D_{max}$–d should be changed proportionally, e.g. for a core diameter d=144 mm, all limiting values should be doubled (which results in limiting values from 2*2=4 mm to 2*0.5=1 mm). In the Examples below, the maximum diameter $D_{max}$= 71+2*0.7=72.4 mm, while the core diameter d=72.0 mm. If the core is less resilient, because the core thickness is increased or because the core is made of a stronger material than cardboard, the above limiting values for $D_{max}$–d should be decreased. The above limiting values also depend upon the exact geometry of the helical protrusion, which includes the angles λ, α and β (see also FIG. 6 for some possible geometries). Because so many characteristics of the flange and the core influence the manual removability of the flange—the material properties of both the flange and the core, their dimensions and the tolerances on these dimensions—a few experiments may be necessary in order to determine the dimensions of the flange and the core. For a cardboard core with an inner diameter d between 60 and 80 mm, a good starting value for the maximum hub diameter is $D_{max}$=d+0.5 mm. If, for this value, the torque required to remove the flange is too large, $D_{max}$ should be decreased (or d should be increased). Care should also be taken that the force $F_{out}$ remains large enough, i.e. the force that is required to pull the flange axially out of the core. The force $F_{out}$ may change considerably because of the tolerance on the inner core diameter d, if cardboard cores are used. Usually, at most three or four experiments will be sufficient to determine the dimensions of a composition of a flange and a core according to the present invention, once the materials are chosen of which the flange and the core are made.

In an embodiment in accordance with the present invention, the outer diameter of the disc portion 21 of the flange 20 is large enough so that the flange 20 can be removed from the core manually, by turning. Preferably, the maximum diameter of the flange 20 is larger than 40 mm, more preferably larger than 50 mm, still more preferably larger than 60 mm, while the maximum diameter of the flange 20 always remains smaller than 200 mm.

The embodiments disclosed hereinbefore are preferred embodiments, but the present invention is not limited to these embodiments.

The strip material (60) that is coiled upon the core (10) need not be light-sensitive; it may e.g. be sensitive to infrared radiation. Preferably, the strip material (60) is radiation-sensitive, such as photographic or thermographic material.

Preferably, for a roll of light-sensitive strip material, the maximum diameter of the flanges 20 is larger than the diameter of the coiled strip material 60 and the circumferential cover 61. The maximum flange diameter may however be equal to or smaller than the diameter of the coiled strip material; in this case the circumferential cover 61 may be secured to the outside of the flanges, i.e. the side of the disc portion opposite to the side that is turned towards the hub portion.

A hub having a conical or cylindrical shape is preferred, but the hub may also have another shape, e.g. a slightly hyperbolical shape, provided it may be inserted into the core by pressing or screwing and it may be removed from the core by exertion of a pure torque.

Preferably, the flange 20 is pressed into the core 10, but it may also be screwed into the core, by exerting a torque on the flange 20 instead of a pushing force.

In a preferred embodiment, the flange 20 is directly attached to the core. In another embodiment, the flange 20 is attached to the core via another part, e.g. via a ring that is secured to the core at the core end.

In a preferred embodiment, the flange 20 comprises a disc portion 21 and a hub portion 23 having a helical protrusion 30. In another embodiment, the flange 20 comprises a hub portion 23 having a helical protrusion 30, and e.g. a rim. The rim secures a disc, or another part, to the core 10.

Preferably, two flanges in accordance with the present invention are attached to the core. In another embodiment, a flange according to the present invention may be attached to the first end 11 of the core, and a flange according to prior art may be attached to the second end 12 of the core. In yet another embodiment, one flange may be is attached to the first end 11 of the core, and no flange is attached to the second end 12 of the core.

In a preferred embodiment, the two flanges that are attached to the core are in accordance with the present invention, and have the same features, with a preferred exception for the helix angle λ: as explained hereinbefore, preferably the first flange has a right-hand turning helix and the second flange a left-hand turning helix, or vice versa. In another embodiment, the two flanges have different features: the first flange has screw thread and the second flange has short, discrete protrusions; in yet another embodiment, the first flange has a helix angle λ=25° and the second flange has a helix angle λ=40°; etc.

Preferably, all helical protrusions on a hub have cross sections having the same features, in particular the same angles a and β. However, the helical protrusions may have cross sections with differing features.

A flange according to the present invention provides important advantages.

Existing rolls and cores may be used, only the flanges are modified.

Manufacturing the flanges is easy. The core does not have to comprise protrusions: a simple, inexpensive tube, e.g. made of cardboard, is sufficient. In a preferred embodiment σ>1, whereby the flanges remain so reliably attached to the core, that the dimensional tolerances on the core may be larger, which means a cheaper core may be used.

A light-sensitive strip material on a core with flanges according to the current invention can be packaged light-tightly, and the packaging process can easily be automated.

The flanges remain reliably attached to the core during shipping, handling and use of the roll.

The flanges can be used to drive the roll in a cooperating apparatus.

The flanges can easily be removed, which is an environmental advantage.

The flanges can be removed manually. No tool is required to remove the flanges. This is convenient for the user.

Removal of the flanges is fast.

EXAMPLES

We measured $F_{in}$, i.e. the force required to press the flange axially into the core, and $F_{out}$, i.e. the force required to pull the flange axially out of the core, for prior art flanges A and B having ribs (see FIG. 1) and for a flange according to the present invention, having the features described below.

The results of these measurements are found in the following table:

| | $F_{in}$ [N] | $F_{out}$ [N] | $\eta = F_{out}/F_{in}$ |
|---|---|---|---|
| prior art flange (A) | 600 | 300 | 0.5 |
| prior art flange (B) | 200 | 100 | 0.5 |
| flange acc. invention | 200 | 250 | 1.25 |

Forces were measured for two prior flanges, (A) and (B). Although these flanges have the same nominal dimensions, the forces are different because of the dimensional tolerances of the flanges and the core.

For a flange according to the present invention, $\eta$ may be larger than 1 thanks to a good choice of the specific features of the flange, especially the dimension and the angles $\lambda$, $\alpha$ and $\beta$ of the helical protrusion.

The flange according to the present invention, used for the measurement, was part of a roll; the roll and the flange have the following features:

roll: weight=1 kg per 100 mm roll length coiled strip material:
diameter=124 mm
contains 60 m of HeNe recording film,
having a thickness of 110 $\mu$m core: material: cardboard
inner diameter=72.0 mm
thickness=2.5 mm flange: material: ABS, i.e. acrylonitrile butadiene styrene
disc portion:
diameter=130 mm
thickness=3 mm
hub portion:
cylindrical
diameter=71 mm
length=47 mm helical protrusion: (material: the same material as the flange)
continuous (=screw thread)
protrusion height=0.7 mm
$\lambda$=7°40'
$\alpha$=30°
$\beta$=90°

To remove the flange from the core, a torque of 7 Nm was exerted upon the flange.

Having described in detail preferred embodiments of the current invention, it will now be apparent to those skilled in the art that numerous modifications can be made therein without departing from the scope of the invention as defined in the appending claims.

parts list

10 core
11, 12 core end
20, 40 flange
21, 41 disc portion
22 inner diameter of disc portion
23, 43 hub portion
24 rib
25 protrusion
26 axis
27 hub end
28 protruding element
29 hole
30, 31 helical protrusion
32, 33 helix
60 strip material
61 circumferential cover
80 roll

What is claimed is:

1. A composition spool comprising:

a core having an inner diameter d, a smooth inner surface, a center and an end, said core being made of cardboard; and a flange comprised of polymeric material, said flange having:

a disc portion having a first outer diameter; and a hub portion for fitting axially within the core, the hub portion having a second outer diameter D and a helical protrusion, the helical protrusion having a height h;

wherein the first outer diameter of the disc portion is larger than 40 mm and smaller than 200 mm and the dimensions in millimeters of the inner diameter d of the core, the second outer diameter D of the hub portion and the height h of the helical protrusion are such that the value of Dmax-d$\leqq$d/72 (2.0 mm), where Dmax is the maximum permissible value of D.

2. The composition spool of claim 1, wherein the value of Dmax-d$\leqq$d/72 (1.0 mm).

3. The composition spool of claim 1, wherein the value of Dmax-d$\leqq$d/72 (0.7 mm).

4. The composition spool of claim 1, wherein the value of Dmax-d$\leqq$d/72 (0.5 mm).

5. The composition spool of claim 1, wherein the flange is manually removable from the core by exerting upon the flange a pure torque of no more than 30 Nm.

6. The composition spool of claim 1, wherein the flange is removable from the core by rotating the flange by at most two complete revolutions.

7. The composition spool of claim 1, wherein the spool has a force efficiency $\eta$>1, $\eta$ being the ratio of the force required to pull the flange axially out of the core, divided by the force required to press the flange axially into the core.

8. The composition spool of claim 1, wherein an angle $\alpha$, between the helical protrusion and the inner surface of core at the side of the center of the core, is smaller than an angle $\beta$, between the helical proutusion and the inner surface of the core at the side of the end of the core.

9. The composition spool of claim 1, further comprising a strip of radiation-sensitive material wound on said core.

10. The composition spool of claim 9, further comprising a flexible circumferential cover covering the strip material.

* * * * *

UNITED STATES PATENT AND TRADEMARK OFFICE

CERTIFICATE OF CORRECTION

PATENT NO. : 6,182,921 B1
DATED : February 6, 2001
INVENTOR(S) : Muylle et al.

It is certified that error appears in the above-identified patent and that said Letters Patent is hereby corrected as shown below:

Title page, Item [54], Title, and Column 1, line 1,
"FLANGE FOR A ROLL" should read -- MANUALLY REMOVABLE FLANGE FOR A ROLL --
Item [60], Related U.S. Application Data: ", now abandoned."

Column 1,
Line 5, cancel ", now expired."

Column 3,
Line 16, "A specific" should read -- ¶A specific --

Column 4,
Line 40, "a" should read -- --

Column 10,
Line 14, "is" should be deleted
Line 31, "a" should read -- --
Line 38, "easy. The" should read -- easy. ¶The --
Line 41, " >1," should read -- >1, --

Column 11,
Line 21, "length coiled" should read -- length ¶coiled --

Signed and Sealed this

Eleventh Day of December, 2001

*Attest:*

Nicholas P. Godici

*Attesting Officer*

NICHOLAS P. GODICI
*Acting Director of the United States Patent and Trademark Office*